US010192653B2

(12) United States Patent
Fujikawa et al.

(10) Patent No.: US 10,192,653 B2
(45) Date of Patent: Jan. 29, 2019

(54) TWISTED STRING-SHAPED ELECTRIC CABLE FOR UNDERWATER PURPOSE

(71) Applicant: Panasonic Intellectual Property Management Co., Ltd., Osaka (JP)

(72) Inventors: Dai Fujikawa, Osaka (JP); Hiroshi Miyai, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/872,120

(22) Filed: Jan. 16, 2018

(65) Prior Publication Data

US 2018/0137952 A1 May 17, 2018

Related U.S. Application Data

(63) Continuation of application No. PCT/JP2016/003099, filed on Jun. 28, 2016.

(30) Foreign Application Priority Data

Jul. 16, 2015 (JP) ..... 2015-142442

(51) Int. Cl.

| | |
|---|---|
| ***H01B 7/02*** | (2006.01) |
| ***H01B 7/04*** | (2006.01) |
| ***H01B 7/12*** | (2006.01) |
| ***H01B 7/14*** | (2006.01) |
| ***H01B 3/44*** | (2006.01) |

(52) U.S. Cl.

CPC ..... *H01B 7/0241* (2013.01); *H01B 3/441* (2013.01); *H01B 7/045* (2013.01); *H01B 7/12* (2013.01); *H01B 7/14* (2013.01)

(58) Field of Classification Search

None

See application file for complete search history.

(56) References Cited

U.S. PATENT DOCUMENTS 1,837,795 A * 12/1931 Schneider ..... H01B 9/00 174/115
2,012,126 A * 8/1935 Gilbert ..... H01B 7/14 174/108

(Continued)

FOREIGN PATENT DOCUMENTS

JP 58-150913 9/1983
JP 61-200089 9/1986

(Continued)

OTHER PUBLICATIONS

International Search Report dated Aug. 2, 2016 in International (PCT) Application No. PCT/JP2016/003099.

*Primary Examiner* — Dimary Lopez Cruz
*Assistant Examiner* — Muhammed Azam
(74) *Attorney, Agent, or Firm* — Wenderoth, Lind & Ponack, L.L.P.

(57) ABSTRACT

An electric cable includes at least one electric wire, and a plurality of string-shaped bodies each extending in a longitudinal direction of the electric cable and twisting with one another around the at least one electric wire being a core. The plurality of string-shaped bodies has connection parts twisting with one another excluding the at least one electric wire. The connection parts are connected to a frame of an underwater robot.

13 Claims, 7 Drawing Sheets

(56) References Cited

U.S. PATENT DOCUMENTS 2,273,200 A * 2/1942 Hoff ..... B60C 9/0042 138/126
2,348,752 A * 5/1944 Quayle ..... H01B 11/1847 174/27
2,442,785 A * 6/1948 Shapiro ..... H01B 7/12 174/102 R
2,788,023 A * 4/1957 Renaud ..... D03D 11/00 139/410
3,020,334 A * 2/1962 Riley ..... H01B 7/14 174/107
3,023,267 A * 2/1962 Eager Jr. ..... H01B 7/00 174/113 R
3,439,111 A * 4/1969 Miracle ..... H01B 11/1016 174/107
3,466,881 A * 9/1969 Lamy ..... F16L 1/14 405/166
3,483,313 A * 12/1969 Schaffhauser ..... H01B 7/0072 174/101.5
3,554,879 A * 1/1971 Shotton et al. ..... C23C 18/28 205/138
3,656,360 A * 4/1972 Fix ..... B29D 29/10 156/140
4,110,554 A * 8/1978 Moore ..... D07B 1/147 174/101.5
4,116,285 A * 9/1978 Guerber ..... E21B 4/16 166/288
4,252,914 A * 2/1981 Halasa ..... C08L 23/02 522/112
4,695,127 A * 9/1987 Ohlhaber ..... G02B 6/443 174/70 R
4,731,504 A * 3/1988 Achille ..... H01B 3/441 174/107
4,876,147 A * 10/1989 Schlag ..... C08L 23/06 428/379
5,109,457 A * 4/1992 Panuska ..... G02B 6/4415 174/23 R
5,195,393 A * 3/1993 Wolfington ..... B60T 11/046 174/110 PM
5,268,971 A * 12/1993 Nilsson ..... G02B 6/4407 385/101
5,408,562 A * 4/1995 Yoshizawa ..... G02B 6/4408 385/110
5,442,903 A * 8/1995 Lagarrigue ..... D02G 3/26 57/236
5,557,698 A * 9/1996 Gareis ..... G02B 6/4416 385/100
5,744,757 A * 4/1998 Kenny ..... C08L 23/10 174/110 PM
5,767,441 A * 6/1998 Brorein ..... H01B 7/0876 174/27
6,037,546 A * 3/2000 Mottine ..... H01B 3/441 174/110 PM
6,247,359 B1 * 6/2001 De Angelis ..... D07B 1/14 73/158
6,297,455 B1 * 10/2001 Wijnberg ..... H01B 7/046 174/113 R
6,329,056 B1 * 12/2001 Deve ..... C22C 47/062 164/100
6,485,796 B1 * 11/2002 Carpenter ..... C22C 47/064 427/177
6,704,481 B2 * 3/2004 Gaillard ..... H01B 7/385 385/113
7,461,500 B2 * 12/2008 Theis ..... D07B 1/145 57/238
7,763,802 B2 * 7/2010 Varkey ..... H01B 7/046 174/106 R
9,601,233 B1 * 3/2017 Kithuka ..... H01B 3/441
9,605,515 B2 * 3/2017 O'Malley ..... E21B 41/0007
9,729,253 B2 * 8/2017 Tobias ..... H04B 13/02
9,919,662 B2 * 3/2018 Hayakawa ..... B60R 16/0215
2001/0013418 A1 * 8/2001 Donner ..... H01B 11/02 174/27
2002/0110339 A1 * 8/2002 Dittmann ..... H01B 11/22 385/101
2002/0144497 A1 * 10/2002 Scheunemann ..... D07B 1/02 57/282
2004/0112628 A1 * 6/2004 Brandi ..... H01B 11/04 174/113 R
2007/0044991 A1 * 3/2007 Varkey ..... H01B 7/046 174/102 R
2007/0205009 A1 * 9/2007 Figenschou ..... F16L 11/127 174/47
2009/0120663 A1 * 5/2009 Karlsen ..... H01B 7/14 174/113 R
2010/0246331 A1 * 9/2010 Paul ..... F16L 11/086 367/173
2011/0005795 A1 * 1/2011 Deighton ..... H01B 7/045 174/47
2012/0000690 A1 * 1/2012 Van Der Meer ..... H01B 7/2825 174/102 R
2012/0163120 A1 * 6/2012 Pearce ..... G01V 1/186 367/21
2012/0168199 A1 7/2012 McCullough et al.
2012/0234597 A1 * 9/2012 Madden ..... H02G 9/12 174/74 R
2013/0220667 A1 * 8/2013 Millan Perez ..... C08L 23/08 174/120 SR
2014/0102749 A1 * 4/2014 Varkey ..... H01B 7/046 174/102 R
2014/0102755 A1 * 4/2014 Adriaenssens ..... H01B 11/1895 174/113 R
2014/0345906 A1 11/2014 McCullough et al.
2015/0325336 A1 * 11/2015 Maples ..... H01B 7/326 324/539
2015/0325337 A1 11/2015 McCullough et al.
2016/0119065 A1 * 4/2016 Tobias ..... G03B 17/08 348/81
2016/0202378 A1 * 7/2016 Ridsdill-Smith ..... G01V 1/133 367/21
2016/0343471 A1 * 11/2016 Ernst ..... H01B 7/0275
2017/0190387 A1 * 7/2017 Betcher ..... B63B 21/26
2017/0218919 A1 * 8/2017 Wong ..... F03D 1/0666
2017/0271046 A1 * 9/2017 Parke ..... H01B 7/17

FOREIGN PATENT DOCUMENTS

| | | |
|---|---|---|
| JP | 62-201428 | 12/1987 |
| JP | 64-4022 | 1/1989 |
| JP | 2003-45237 | 2/2003 |
| JP | 2007-299562 | 11/2007 |
| JP | 2012-533849 | 12/2012 |
| WO | 2011/008568 | 1/2011 |

* cited by examiner

TWISTED STRING-SHAPED ELECTRIC CABLE FOR UNDERWATER PURPOSE

BACKGROUND

Technical Field

The present disclosure relates to an electric cable through which an electric current flows.

Description of the Related Art

There has been known an underwater robot that performs operations underwater. For example, as described in PTL 1, an underwater robot is connected with a control device on land through a cable and is remotely operated wiredly by the control device through this cable.

The cable in PTL 1 is composed of multiple optical fiber cords, multiple power wires, an anti-tensile body made of aramid fiber, a jelly-like admixture bonding all of these components together, and a sheath made of elastomer for buoyancy and protection. The optical fiber cord is composed of optical fiber, an anti-tensile body, a sheath, and a reinforce layer. With this composition, the cable has a high tensile strength while protecting its transmission path for power or signals.

CITATION LIST

PTL

PTL 1: Japanese Patent Unexamined Publication No. S61-200089

SUMMARY

The present disclosure offers an electric cable, that protects its transmission path for signals or power and provides a high tensile strength as well as flexibility for free handling.

To fulfil the above-described technological requirements, one aspect of the disclosure provides an electric cable. The electric cable includes at least one electric wire, and a plurality of string-shaped bodies each extending in a longitudinal direction of the electric cable and twisting with one another around the at least one electric wire being a core. The plurality of string-shaped bodies has a connection part twisting with one another excluding the at least one electric wire. The connection part is connected to a frame of an underwater robot.

Another aspect of the disclosure provides an electric cable that includes a plurality of string-shaped structures each extending in a longitudinal direction of the electric cable and twisting with one another. Each of the plurality of string-shaped structures has a plurality of string-shaped bodies each extending in the longitudinal direction and twisting with one another. At least one of the plurality of string-shaped structures has an electric wire. The at least one of the plurality of string-shaped structure having the electric wire has a structure in which the plurality of string-shaped bodies twisting with one another around the electric wire being a core. The plurality of string-shaped bodies has a connection part twisting with one another excluding the electric wire. The connection part is connected to the frame of an underwater robot.

Further another aspect of the disclosure provides an electric cable that includes a plurality of string-shaped structures each extending in a longitudinal direction of the electric cable and twisting with one another. Each of the plurality of string-shaped structures has a plurality of string-shaped bodies each extending in the longitudinal direction and twisting with one another. Each of at least two of the plurality of string-shaped bodies has one electric wire. The string-shaped structure having the one wire has a structure in which the plurality of string-shaped bodies twisting with one another around the one electric wire being a core.

The present disclosure offers an electric cable, that protects its transmission path for signals or power and provides a high tensile strength as well as flexibility for free handling.

DETAILED DESCRIPTION OF THE PREFERRED EMBODIMENTS

Figure 1:
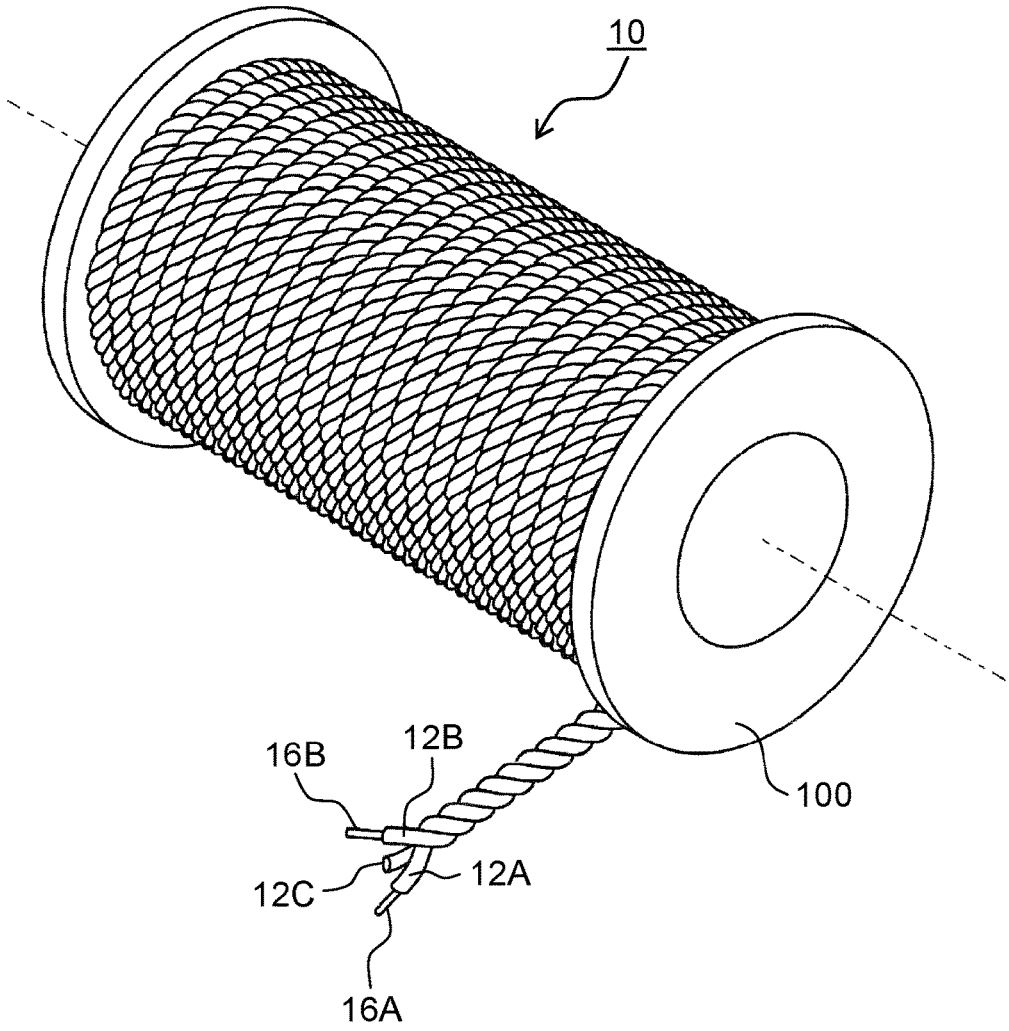
FIG. 1 is a perspective view illustrating an electric cable according to an exemplary embodiment, in a stored state.

An electric cable of one aspect of the disclosure has a plurality of string-shaped structures each extending in the longitudinal direction and twisting with one another. Each of the plurality of string-shaped structures has a plurality of string-shaped bodies each extending in the longitudinal direction and twisting with one another. At least one of the plurality of string-shaped structures includes an electric wire through which an electric current flows, and the plurality of string-shaped bodies twist with one another around the electric wire being a core.

Such a configuration offers an electric cable, that protects its transmission path for signals or power and provides a high tensile strength as well as flexibility for free handling.

For example, two of the plurality of string-shaped structures have electric wires, and each of the two string-shaped structures has one electric wire. This allows the two electric wires to work as a twisted pair wire. Hence, the electric cable has high transmission characteristics.

The string-shaped body is made of a material with a density lower than that of water for example. This allows the electric cable to float in water, and thus to be handled freely in water.

The string-shaped body is made of polypropylene for example. Polypropylene has a density lower than that of water, and a lighter weight and a higher tensile strength than the other synthetic fiber materials. Accordingly, the electric cable floats in water for free handling in water, and is light for free handling on land as well. Furthermore, being made of polypropylene provides a higher tensile strength of the electric cable than a case where the string-shaped body is made of another synthetic-fiber material.

For example, the string-shaped body is formed of multiple fiber threads each extending in the longitudinal direction and twisting with one another. Such an electric cable provides a higher flexibility than a case where the string-shaped body is formed of a single wire, allowing the cable to be handled more freely.

An electric cable of one aspect of the disclosure includes an electric wire through which an electric current flows, and a plurality of string-shaped bodies each extending in the longitudinal direction and twisting with one another around the electric wire being a core.

Such a configuration offers an electric cable, that protects its transmission path for signals or power and provides a high tensile strength as well as flexibility for free handling.

Hereinafter, a detailed description is made of some embodiments with reference to the related drawings as appropriate. However, a detailed description more than necessary may be omitted, such as a description of a well-known item and a duplicate description for a substantially identical component, to avoid an unnecessarily redundant description and to allow those skilled in the art to easily understand the following description.

Note that the inventors provide accompanying drawings and the following description for those skilled in the art to well understand the disclosure and do not intend that the drawings and the description limit the subjects described in the claims.

Figure 2:
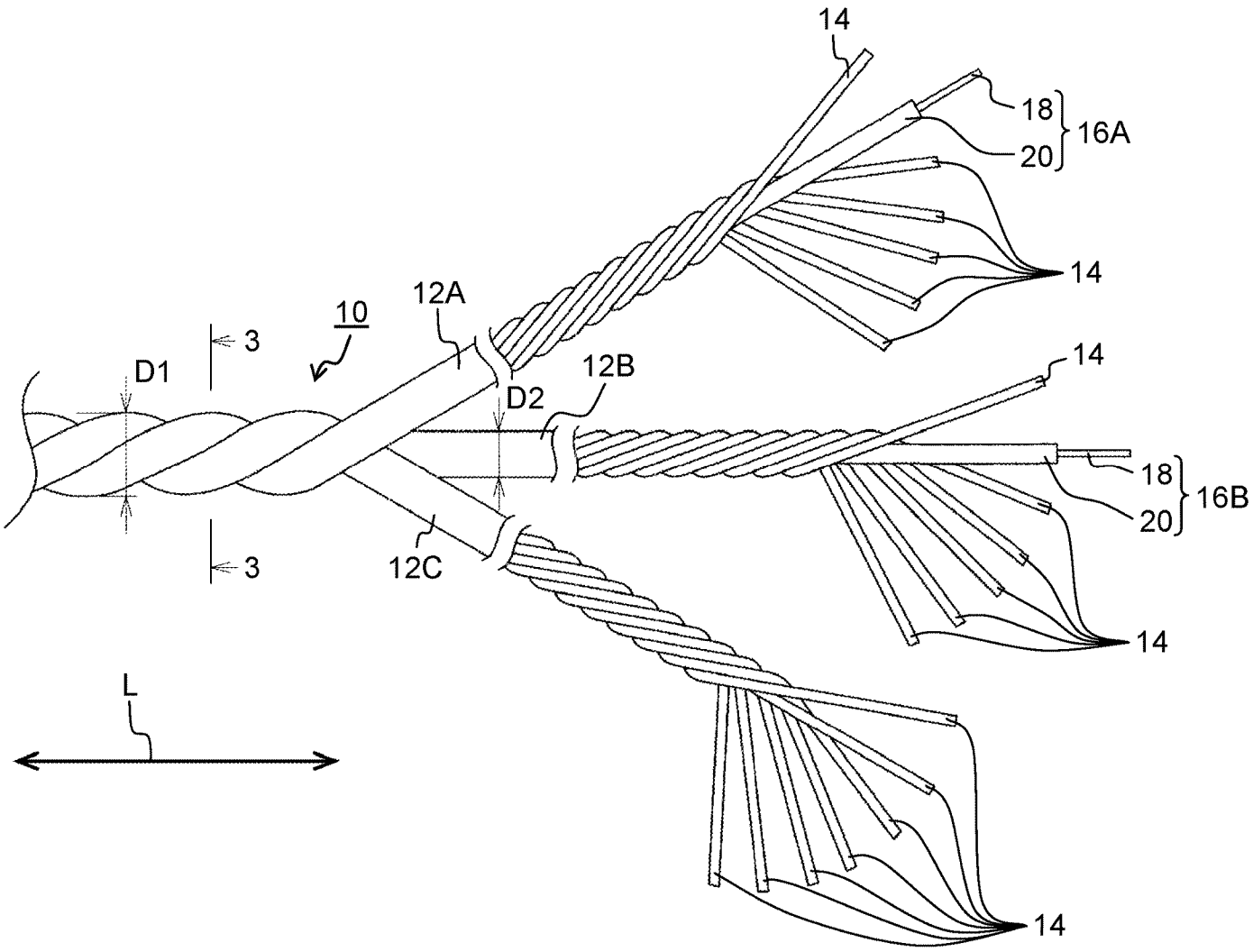
FIG. 2 illustrates a configuration of the electric cable according to the embodiment.
Figure 3:
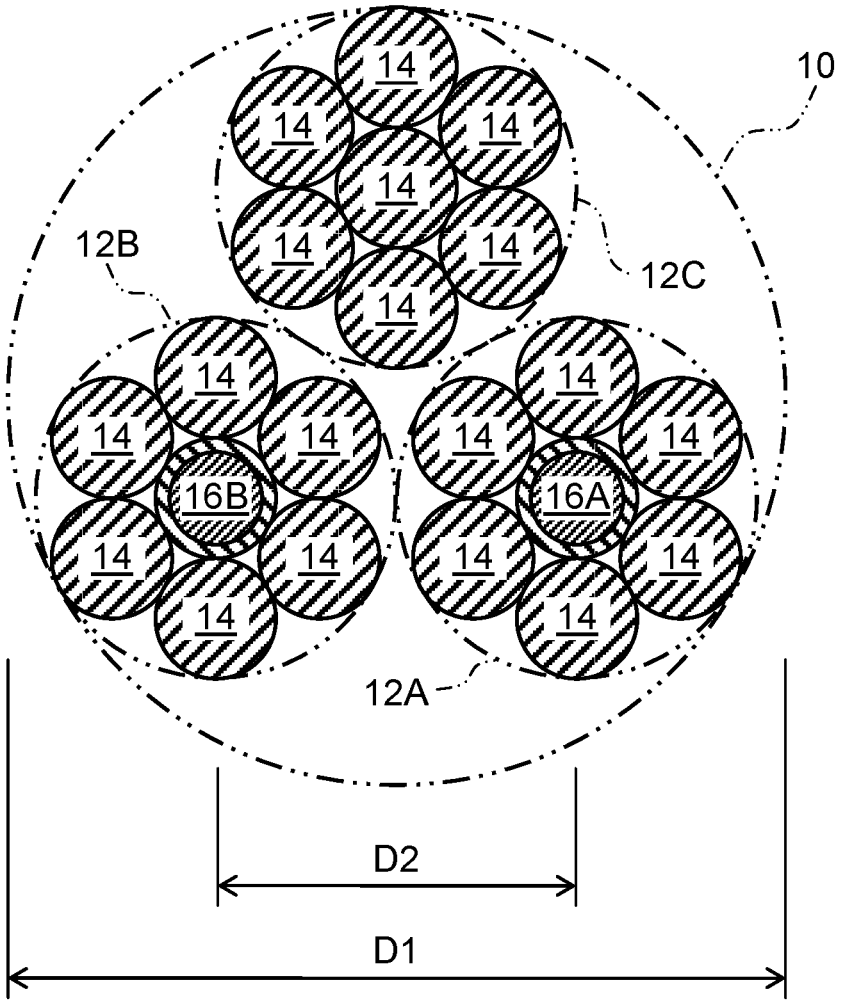
FIG. 3 is a sectional view of the electric cable of FIG. 2, taken along line 3-3.

FIG. 1 illustrates an electric cable according to one exemplary embodiment, in a stored state. FIG. 2 illustrates a configuration of the electric cable. FIG. 3 is a sectional view of the electric cable of FIG. 2, taken along line 3-3.

As shown in FIG. 1, electric cable 10 in this embodiment is rope-like and flexible enough to be wound around reel 100 with a small external diameter, and is stored in a state wound around reel 100. Electric cable 10 is partly drawn out from reel 100 for use.

Concretely, as shown in FIG. 2, electric cable 10 includes three string-shaped structures 12A through 12C each extending in the longitudinal direction and twisting with one another. The term "the longitudinal direction" in this description refers to the longitudinal direction of electric cable 10, namely the extending direction indicated by arrow L in FIG. 2.

In this embodiment, three string-shaped structures 12A through 12C twist with one another, and concretely the respective structures extend in the longitudinal direction in a coil form and intertwine with one another. Accordingly, electric cable 10 is like a three-strand rope.

Each of string-shaped structures 12A through 12C includes a plurality of string-shaped bodies 14 each extending in the longitudinal direction and twisting with one another. In this embodiment, each of string-shaped structure 12A and 12B has six string-shaped bodies 14 each extending in the longitudinal direction in a coil form and intertwining with one another (like a six-strand rope). String-shaped structure 12C has seven string-shaped bodies 14 each extending in the longitudinal direction in a coil form and intertwining with one another.

In this embodiment, string-shaped body 14 is made of a material with a density lower than that of water (the reason is described later). In other words, string-shaped body 14 is made of a material that floats in water. String-shaped body 14 is made of polypropylene or polyethylene for example. Polypropylene that is light in the weight per unit length and has a high tensile strength and insulation is favorable as a material of string-shaped body 14.

String-shaped body 14 itself may be formed of one fiber thread with a large diameter, or multiple fiber threads with a small diameter each extending in the longitudinal direction and twisting with one another, where the latter has a higher flexibility. For a string-shaped body of multiple fiber threads, they may be either synthetic fiber (e.g., polypropylene) or natural fiber (e.g., hemp).

If string-shaped body 14 is formed of multiple fiber threads twisting with one another, electric cable 10 has a characteristic just like a rope. More specifically, string-shaped structures 12A through 12C correspond to strands of a rope, and string-shaped body 14 corresponds to yarn of the rope. Hence, if fiber threads forming string-shaped body 14 is the same as those forming yarn of a rope, electric cable 10 has a tensile strength and flexibility substantially same as those of the rope. For example, if the fiber thread is made of polypropylene, electric cable 10 with diameter D1 of 9 mm has a tensile strength of approximately 11 kN, like a polypropylene rope with the same diameter.

As shown in FIG. 2, string-shaped structures 12A and 12B are formed of a plurality of string-shaped bodies 14 twisting with one another around electric wires 16A and 16B (through which an electric current flows) being cores. More specifically, at the centers of string-shaped structure 12A and 12B, electric wires 16A and 16B respectively extend in the longitudinal direction. Each of a plurality of string-shaped bodies 14 extend in the longitudinal direction in a coil form with each of electric wires 16A and 16B being a center. Consequently, electric wires 16A and 16B are protected by a plurality of string-shaped bodies 14. As shown in FIGS. 2 and 3, string-shaped structure 12C has string-shaped body 14, instead of an electric wire, as a core at the center, and is formed of six string-shaped bodies 14 twisting with one another around string-shaped body 14. String-shaped structures 12A through 12C are approximately the same in diameter. Here, string-shaped structure 12C may be formed of seven string-shaped bodies 14.

Electric wires 16A and 16B of string-shaped structures 12A and 12B include conducting wire 18 through which an electric current flows, namely through which signals or power are transmitted, and coating cover 20 that coats conducting wire 18 for protection. Conducting wire 18 is made of a conductive material with a high flexibility, such as copper. Coating cover 20 is made of polyethylene with a high flexibility and insulation.

Electric cable 10 of the configuration above protects electric wires 16A and 16B, which are a transmission path for signals or power, and provides a high tensile strength as well as flexibility for free handling.

In other words, electric cable 10 plays a role of transmitting signals or power through electric wires 16A and 16B. Electric cable 10 has functions substantially the same as those of a rope by means of a plurality of string-shaped bodies 14 composing string-shaped structures 12A through 12C by twisting respectively with a plurality of string-shaped structures 12A through 12C twisting with one another. Accordingly, electric cable 10 has a tensile strength substantially equivalent to that of a rope, and is flexible enough to be handled freely like a rope.

Electric wires 16A and 16B of string-shaped structures 12A and 12B function as a twisted pair wire with high transmission characteristics in transmitting high-frequency signals (e.g., differential signals).

Concretely, each of string-shaped structures 12A and 12B extends in the longitudinal direction in a coil form and intertwining with the other, and so does each of internal electric wires 16A and 16B. Thus, electric wires 16A and 16B form a twisted pair wire. Accordingly, electric wires 16A and 16B are less subject to the influence of noise than a parallel wire in transmitting signals.

As shown in FIG. 3, a plurality of string-shaped bodies 14 winds around each of electric wires 16A and 16B. Further, string-shaped structure 12A having electric wire 16A and string-shaped structure 12B having electric wire 16B are twisted with each other. Accordingly, distance D2 between electric wires 16A and 16B is approximately equal to the diameter of string-shaped structures 12A and 12B, and is approximately uniform regardless of the position in the extending direction of electric cable 10. Furthermore, however electric cable 10 is bent, the distance between electric wires 16A and 16B hardly changes. In other words, the stray capacitance between electric wires 16A and 16B hardly changes. Hence, however electric cable 10 is bent, the transmission characteristics of electric wires 16A and 16B hardly change. Consequently, electric wires 16A and 16B function as a twisted pair wire with high transmission characteristics.

Regarding the above, electric cable 10 in this embodiment is used with part of it wound around reel 100 as shown in FIG. 1. That is, an electric current flows through the part wound around reel 100 as well. When electric cable 10 is wound around reel 100, stray capacitance occurs between two parts of a twisted pair wire (i.e., electric wires 16A and 16B) adjacent to each other on reel 100. As shown in FIG. 1, however, electric cable 10 closely wound around reel 100 causes the distance between two parts of a twisted pair wire adjacent to each other to be kept approximately equal to diameter D1 of electric cable 10, which suppresses variations in the stray capacitance between the parts. Consequently, a twisted pair wire inside electric cable 10, even if part of electric cable 10 is wound around reel 100, can transmit signals in a stable state of the transmission characteristics.

From here, a description is further made of the functions of electric cable 10 according to this embodiment referring to its examples of use.

Figure 4:
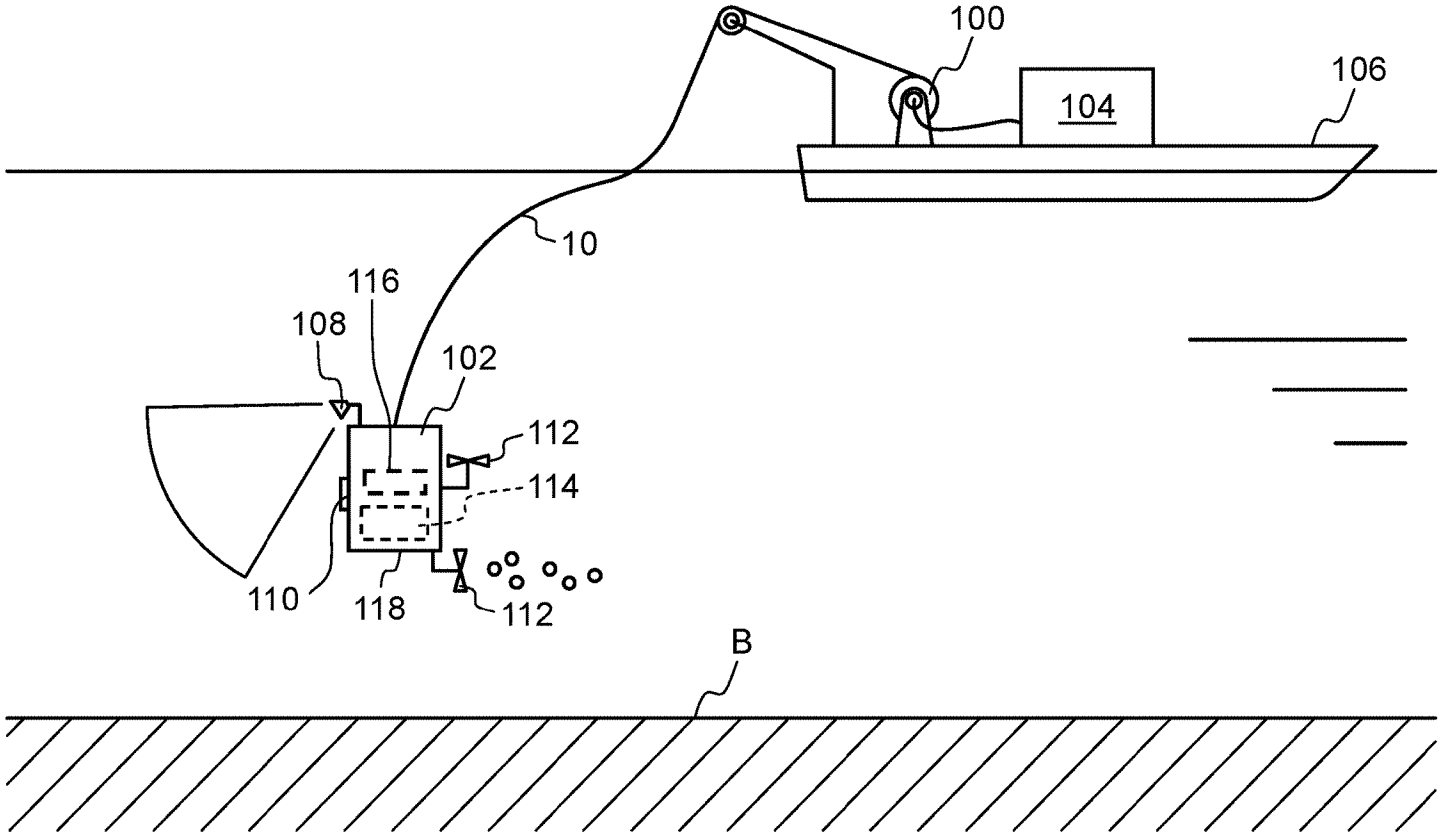
FIG. 4 is a schematic diagram of an underwater robot that uses the electric cable according to the embodiment.

FIG. 4 outlines underwater robot 102 that uses electric cable 10.

As shown in FIG. 4, underwater robot 102, a robot that inspects underwater structures such as a dam and a waterway, is connected to control device 104 through electric cable 10 according to the embodiment. Reel 100 that winds and stores electric cable 10 and control device 104 are placed aboard ship 106.

Underwater robot 102 includes lighting unit 108 illuminating the inside of water, camera 110 for photographing, thruster 112 for moving underwater robot 102 in water, control board 116, and frame 118 as a housing of underwater robot 102. Control board 116 transmits control signals from control device 104 to lighting unit 108, camera 110 for photographing, and thruster 112. This underwater robot 102 has battery 114 aboard. For this reason, electric cable 10 of this example does not transmit power as energy for driving underwater robot 102.

Electric cable 10 connects ship 106 (control device 104) with underwater robot 102 mechanically and electrically. To mechanically connect electric cable 10 with ship 106 and underwater robot 102, electric wires 16A and 16B are separated from electric cable 10 at the two ends of electric cable 10, and the two ends where electric wires 16A and 16B are not provided are respectively connected to the body of ship 106 and frame 118 of underwater robot 102. The ends of electric wires 16A and 16B separated from electric cable 10 close to reel 100 are connected to control device 104; the ends of electric wires 16A and 16B close to underwater robot 102 are connected to control board 116 of underwater robot 102.

Concretely, electric wires 16A and 16B and six string-shaped bodies 14 are separated from each other at the two ends of string-shaped structures 12A and 12B. Each of six string-shaped bodies 14 where electric wires 16A and 16B are separated from string-shaped structures 12A and 12B are twisted with one another to newly form two string-shaped structures where electric wires 16A and 16B are not provided. The two new string-shaped structures and string-shaped structure 12C are twisted with one another to form parts where electric wires 16A and 16B are not provided at the two ends of electric cable 10. Then, the parts where electric wires 16A and 16B are not provided are respectively connected to the body of ship 106 and frame 118 of underwater robot 102. The ends of electric wires 16A and 16B separated are respectively connected to control device 104 and control board 116 of underwater robot 102.

Connecting in this way prevents a tensile force produced when electric cable 10 is wound around reel 100 to pull up underwater robot 102 from underwater from exerting on electric wires 16A and 16B.

Control signals are transmitted from control device 104 to underwater robot 102 through electric cable 10 (its electric wires 16A and 16B). For example, a signal for adjusting the amount of light of lighting unit 108, a signal for controlling photographing of camera 110, and a signal for controlling output of thruster 112 are transmitted from control device 104 to underwater robot 102 through electric cable 10.

Data signals are transmitted from underwater robot 102 to control device 104 through electric cable 10. For example, image data photographed by camera 110 and information about the remaining amount of battery 114 are transmitted as signals from underwater robot 102 to control device 104 through electric cable 10.

As described above, string-shaped body 14 of electric cable 10 is made of a material (e.g., polypropylene) with a density lower than that of water. Hence, even if electric wires 16A and 16B have a density higher than that of water, the density of entire electric cable 10 can be made lower than that of water, resulting in electric cable 10 floating in water.

Figure 5:
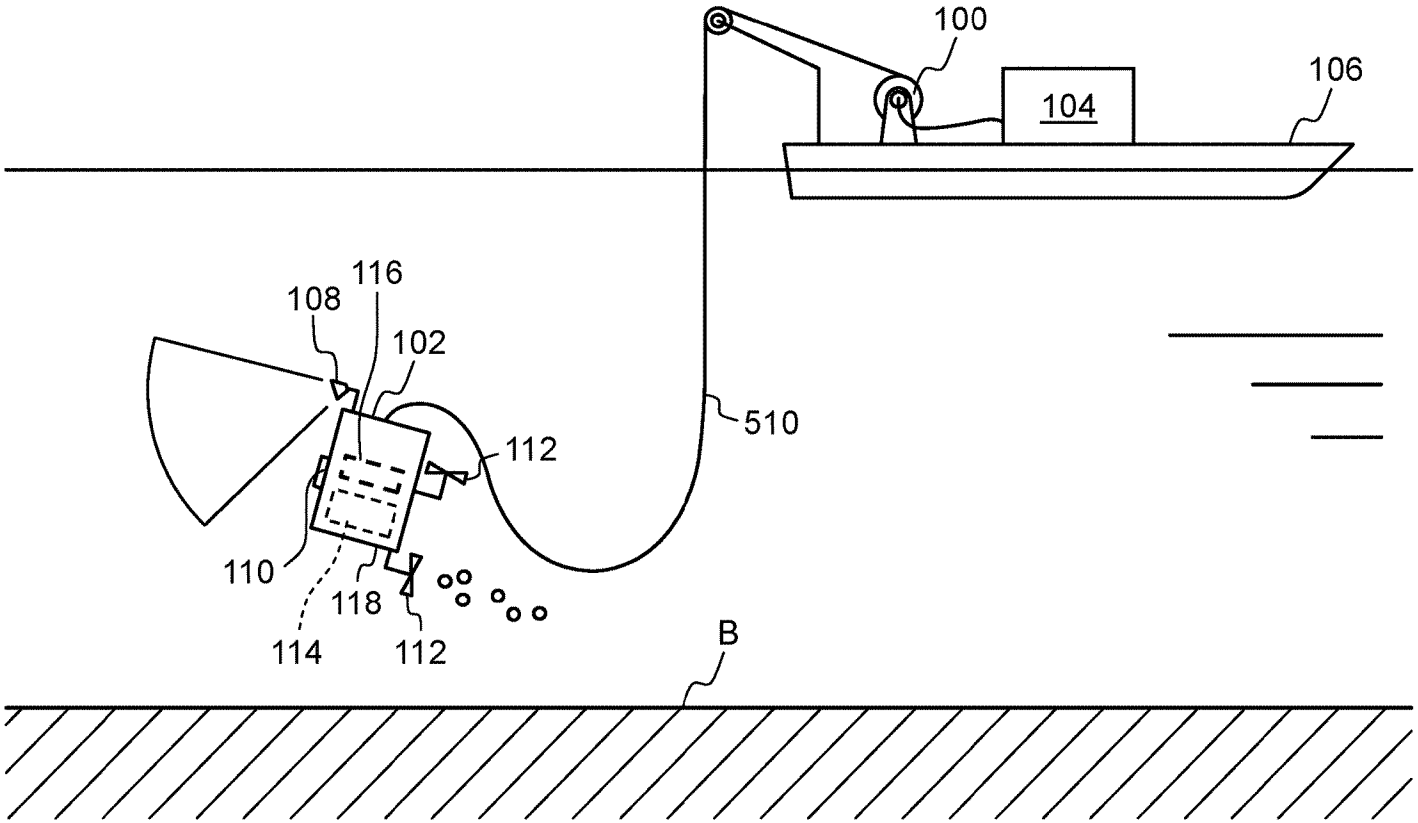
FIG. 5 is a schematic diagram of an underwater robot that uses a comparative example of the electric cable.

Concretely, as shown in FIG. 5, if underwater robot 102 is connected to electric cable 510, which is a comparative example, having a density higher than that of water, electric cable 510 hangs down from underwater robot 102, which can cause electric cable 510 to contact water bottom B. For example, electric cable 510 can tangle in an obstacle on water bottom B, interfering with inspection by underwater robot 102 or retrieval of such underwater robot 102.

In this way, when used underwater, electric cable 10 floats in water to allow it to be handled more freely.

Besides, electric cable 10 can be handled freely like a rope as described above. More specifically, electric cable 10 bends with a small curvature radius because of its high flexibility. Hence, underwater robot 102 is not limited in its action by electric cable 10, thus freely moving underwater. Further, such electric cable 10 can be stored in a small space. For example, as in this embodiment, electric cable 10 can be stored in a state wound around small reel 100.

Furthermore, electric cable 10 has a high tensile strength substantially the same as that of a rope as described above. Concretely, if electric cable 10 has an external diameter same as that of a rope and the material of string-shaped body 14 is the same as that of the rope, electric cable 10 has a tensile strength substantially the same as the rope. Consequently, electric cable 10 can be used for retrieving underwater robot 102 in water.

With the embodiment described above, electric cable 10 protects electric wires 16A and 16B as a transmission path for signals or power and provides a high tensile strength as well as flexibility for free handling.

Note that the present disclosure is not limited to the embodiment described above. For example, electric cable 10 of the embodiment described above is formed of three string-shaped structures 12A through 12C twisting with one another as shown in FIG. 3; besides, two, or four or more, string-shaped structures may be used. It is only required that two or more string-shaped structures are used in order for them to twist with one another. The number of string-shaped structures may be changed in response to a tensile strength required for electric cable 10.

In the embodiment described above, as shown in FIG. 3, string-shaped structures 12A through 12C include six string-shaped bodies 14 twisting with one another; however, it is only required that two or more string-shaped bodies are used for one string-shaped structure. That is, the number of string-shaped bodies for one string-shaped structure may be changed in response to a tensile strength required for electric cable 10.

Figure 6:
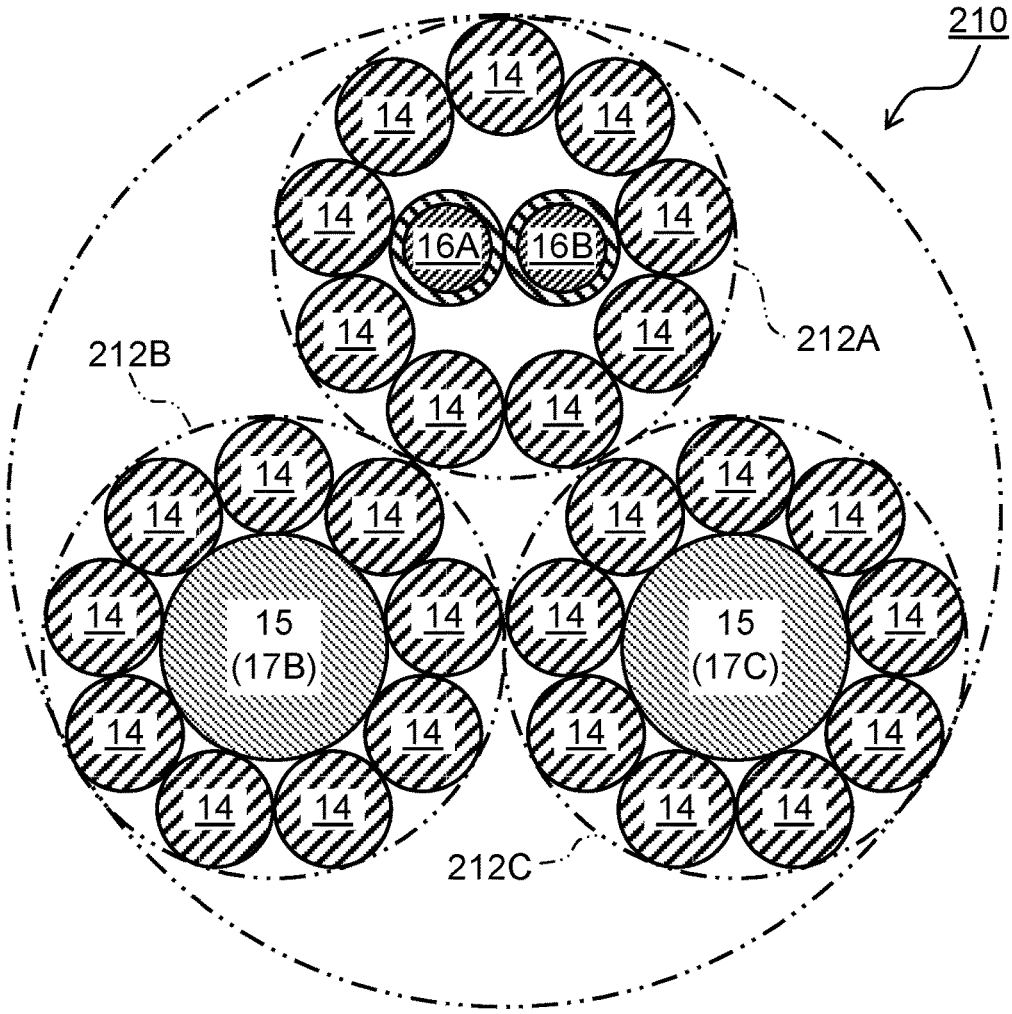
FIG. 6 is a sectional view an electric cable according to another exemplary embodiment.

Furthermore, in the embodiment described above, each of string-shaped structures 12A and 12B has one electric wire 16A and one electric wire 16B as shown in FIG. 3, but other cases are accepted. For example, electric cable 210 according to another embodiment shown in FIG. 6 is formed of multiple (three) string-shaped structures 212A through 212C twisting with one another, and string-shaped structure 212A, one of them, is provided with multiple (two) electric wires 16A and 16B. Electric wires 16A and 16B are twisted with one another to form a core and are protected by nine string-shaped bodies 14 twisted with one another around the core as shown in FIG. 6. The core of string-shaped structure 212A, formed of two electric wires 16A and 16B, has a core diameter substantially larger than those of string-shaped structures 12A through 12C. Accordingly, each of string-shaped structures 212B and 212C has string-shaped body 15 with a diameter larger than that of string-shaped body 14 at the core and nine string-shaped bodies 14 twisted with one another around the core. Accordingly, three string-shaped structures 212A through 212C are formed with their diameters substantially equal to one another.

All of the plurality of string-shaped structures may be provided with electric wires. Instead, the number of electric wires included in electric cable 10 may be changed. For example, underwater robot 102 of the embodiment described above is controlled by control signals from control device 104 through control board 116. Alternatively, underwater robot 102 may be controlled by control device 104, not through control board 116, by connecting the electric wires included in electric cable 10 directly to thruster 112 for example to transmit control signals. In this case, the number of electric wires included in electric cable 10 can be increased in response to the number of devices (e.g., thruster 112) controlled by control device 104.

In the embodiment described above, electric wires 16A and 16B of electric cable 10 are used as a signal line for transmitting signals to underwater robot 102; however, may be used otherwise. For example, electric wires 16A and 16B may be used as a power line for supplying power. In this case, the number and thickness of electric wires provided in string-shaped structures may be changed in response to an application purpose of electric cable 10. For example, in electric cable 210 shown in FIG. 6, string-shaped bodies 15 positioned at the centers of string-shaped structures 212B and 212C can be respectively replaced with electric wires 17B and 17C to transmit control signals using electric wires 16A and 16B of string-shaped structure 212A as well as to supply power using electric wires 17B and 17C.

Additionally, electric cable 10 in the embodiment described above is used for underwater robot 102 that freely moves in water as shown in FIG. 4, and thus its string-shaped body 14 is made of a material (e.g., polypropylene) with a density lower than that of water; however, another material may be used. For example, if the electric cable is not to be used in water, its string-shaped body may have a density higher than that of water.

Figure 7:
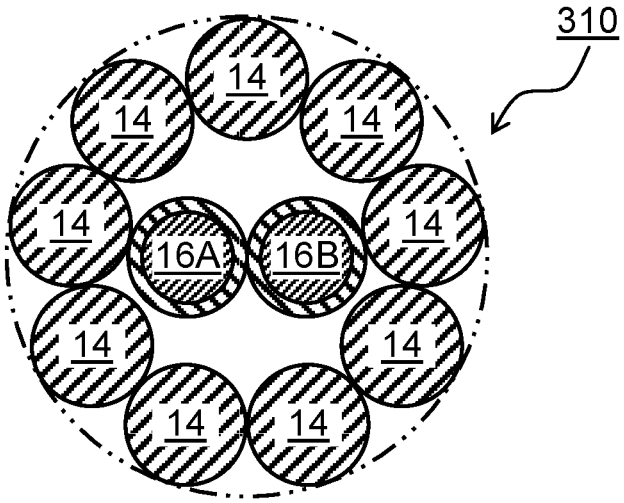
FIG. 7 is a sectional view of an electric cable according to still another exemplary embodiment.

Note that, as shown in FIG. 7, the electric cable may be electric cable 310 that includes electric wires 16A and 16B through which an electric current flows and a plurality of string-shaped bodies 14 extending in the longitudinal direction and twisting with one another with electric wires 16A and 16B being a core. That is, electric cable 310 corresponds to string-shaped structure 212A of electric cable 210 shown in FIG. 6. Even such electric cable 310 protects electric wires 16A and 16B as a transmission path for signals or power and provides a high tensile strength as well as flexibility for free handling.

Then, how to twist a plurality of string-shaped structures, a plurality of string-shaped bodies, and multiple fiber threads (if the string-shaped bodies are formed of multiple fiber threads twisting with one another) is not limited. For example, the plurality of string-shaped bodies may be twisted in an eight-strand rope. Here, the plurality of string-shaped structures, the inside of which electric wires extend, are favorably twisted in a three-strand rope as shown in FIG. 2. This is because string-shaped structures complicatedly twisted can break the internal electric wires.

In the embodiment described above, electric cables 10, 210, and 310 are connected to underwater robot 102; however, the connection destination of them is not limited to underwater robot 102. For example, they can be connected to a flight vehicle for inspecting external walls exposed from the water surface of a bridge pier and a dam for example.

Hereinbefore, the description is made of some embodiments for exemplification of the technologies in the disclosure. For this purpose, detailed descriptions and accompanying drawings are provided. Accordingly, some components described in the detailed descriptions and accompanying drawings may include, besides what is essential for solving problems, what is not essential in order to exemplify the above-described technologies. Hence, the fact that such inessential components are included in the detailed descriptions and accompanying drawings does not mean that such inessential components are immediately acknowledged as essential.

The above-described embodiments are for exemplification of the technologies in the disclosure. Hence, the embodiments may undergo various kinds of change, substitution, addition, and/or omission within the scope of the claims and their equivalent technology.

INDUSTRIAL APPLICABILITY

An electric cable of the present disclosure is applicable to an electric cable that transmits signals or power.

What is claimed is:

1. An electric cable comprising:

at least one electric wire; and a plurality of string-shaped bodies each extending in a longitudinal direction of the electric cable and twisting with one another around the at least one electric wire being a core, wherein the plurality of string-shaped bodies has a connection part twisting with one another excluding the at least one electric wire, and wherein the connection part is connected to a frame of an underwater robot.

2. An electric cable comprising:

a plurality of string-shaped structures each extending in a longitudinal direction of the electric cable and twisting with one another, wherein each of the plurality of string-shaped structures has a plurality of string-shaped bodies each extending in the longitudinal direction and twisting with one another, wherein at least one of the plurality of string-shaped structures has an electric wire, wherein the at least one of the string-shaped structures having the electric wire has a structure in which the plurality of string-shaped bodies twist with one another around the electric wire being a core, wherein the plurality of string-shaped structures has a connection part twisting with one another excluding the electric wire, and wherein the connection part is connected to a frame of an underwater robot.

3. An electric cable comprising:

a plurality of string-shaped structures each extending in a longitudinal direction of the electric cable and twisting with one another, wherein each of the plurality of string-shaped structures has a plurality of string-shaped bodies each extending in the longitudinal direction and twisting with one another, wherein at least two of the string-shaped structures have one electric wire each, and have a structure in which the plurality of string-shaped bodies twist with one another around the one electric wire as a core.

4. The electric cable of claim 1, wherein the at least one electric wire is two electric wires, and wherein the two electric wires form the core twisting with each other.

5. The electric cable of claim 1, wherein each of the plurality of the string-shaped bodies is made of a material with a density lower than a density of water.

6. The electric cable of claim 1, wherein each of the plurality of the string-shaped bodies is made of polypropylene.

7. The electric cable of claim 1, wherein each of the plurality of the string-shaped bodies is formed of a plurality of fiber threads each extending in the longitudinal direction and twisting with one another.

8. The electric cable of claim 2, wherein each of the plurality of the string-shaped bodies is made of a material with a density lower than a density of water.

9. The electric cable of claim 2, wherein each of the plurality of the string-shaped bodies is made of polypropylene.

10. The electric cable of claim 2, wherein each of the plurality of the string-shaped bodies is formed of a plurality of fiber threads each extending in the longitudinal direction and twisting with one another.

11. The electric cable of claim 3, wherein each of the plurality of the string-shaped bodies is made of a material with a density lower than a density of water.

12. The electric cable of claim 3, wherein each of the plurality of the string-shaped bodies is made of polypropylene.

13. The electric cable of claim 3, wherein each of the plurality of string-shaped bodies is formed of a plurality of fiber threads each extending in the longitudinal direction and twisting with one another.

* * * * *